US008272084B2

(12) United States Patent
Spidare et al.

(10) Patent No.: US 8,272,084 B2
(45) Date of Patent: Sep. 25, 2012

(54) PATIENT LIFT WITH HANGER BAR ATTACHMENT

(75) Inventors: Frances Spidare, Copley, OH (US); Kenneth Chapman, Deltona, FL (US); James Zhou, Jiangsu (CN); Roger Wang, Jiangsu (CN)

(73) Assignee: Invacare Corporation, Elyria, OH (US)

( * ) Notice: Subject to any disclaimer, the term of this patent is extended or adjusted under 35 U.S.C. 154(b) by 277 days.

(21) Appl. No.: 12/500,855

(22) Filed: Jul. 10, 2009

(65) Prior Publication Data

US 2010/0005585 A1 Jan. 14, 2010

Related U.S. Application Data

(60) Provisional application No. 61/079,454, filed on Jul. 10, 2008.

(51) Int. Cl.
*A61G 7/10* (2006.01)

(52) U.S. Cl. ..... 5/83.1; 5/81.1 R

(58) Field of Classification Search ..... 5/83.1, 5/81.1 R, 86.1, 87.1, 89.1
See application file for complete search history.

(56) References Cited

U.S. PATENT DOCUMENTS

| | | | | |
|---|---|---|---|---|
| 1,901,377 | A | 3/1933 | Roe | |
| 3,962,737 | A | 6/1976 | James | |
| 3,996,632 | A | 12/1976 | Bakker | |
| 4,712,257 | A * | 12/1987 | James | 5/83.1 |
| D376,886 | S | 12/1996 | Dunn et al. | |
| 5,579,547 | A | 12/1996 | Hunt | |
| 5,892,180 | A | 4/1999 | Carey | |
| 6,201,195 | B1 | 3/2001 | Carey | |
| 6,270,101 | B1 | 8/2001 | Hase | |
| 6,675,412 | B2 | 1/2004 | Faucher et al. | |
| 6,806,430 | B2 | 10/2004 | Downing | |
| 7,634,824 | B2 | 12/2009 | Gramkow et al. | |
| 7,654,593 | B2 | 2/2010 | Hjort | |
| 7,694,360 | B2 | 4/2010 | Tally | |

(Continued)

FOREIGN PATENT DOCUMENTS

CA 2302060 9/2001

(Continued)

OTHER PUBLICATIONS

International Search Report and Written Opinion from PCT/US09/050221 dated Oct. 15, 2009.

(Continued)

*Primary Examiner* — Robert G Santos
*Assistant Examiner* — Brittany Wilson
(74) *Attorney, Agent, or Firm* — Calfee, Halter & Griswold LLP

(57) ABSTRACT

According to one embodiment of the present invention, a patient lift apparatus is provided that includes a hanger bar attachment bumper that comprises a soft material so as to provide a soft impact surface on the patient lift apparatus, the hanger bar attachment comprising a first and second housing adapted to be selectively connected to one another. According to another embodiment of the present invention a patient lift apparatus is provided that includes a hanger bar attachment bumper that comprises a soft material so as to provide a soft impact surface on the patient lift apparatus, the hanger bar attachment bumper comprising a first and second housing adapted to be selectively connected to one another, wherein the hanger bar attachment bumper comprises a surface area and wherein the first housing makes up a larger portion of the surface area of the hanger bar attachment bumper than the second housing.

24 Claims, 6 Drawing Sheets

U.S. PATENT DOCUMENTS

| | | | | |
|---|---|---|---|---|
| 2005/0034231 | A1 | 2/2005 | Huang | |
| 2005/0273927 | A1 | 12/2005 | Tally | |
| 2006/0026755 | A1 | 2/2006 | Bain et al. | |
| 2006/0045708 | A1 | 3/2006 | Bain et al. | |
| 2006/0045709 | A1 | 3/2006 | Bain et al. | |
| 2006/0048297 | A1 | 3/2006 | Mills | |
| 2006/0165483 | A1* | 7/2006 | Moufflet | 403/384 |
| 2009/0165204 | A1 | 7/2009 | Biersteker et al. | |
| 2010/0031439 | A1 | 2/2010 | Spidare et al. | |
| 2010/0129148 | A1* | 5/2010 | Giannasca | 403/361 |
| 2010/0162483 | A1 | 7/2010 | Biersteker et al. | |

FOREIGN PATENT DOCUMENTS

| | | |
|---|---|---|
| DE | 29720658 | 4/1999 |
| DE | 20303002 | 6/2003 |
| FR | 2140053 | 1/1973 |
| JP | 2005-111113 | 4/2005 |
| WO | 95/18592 | 7/1995 |
| WO | 08007222 | 1/2008 |
| WO | 2010/006240 | 1/2010 |
| WO | 2010/017438 | 2/2010 |

OTHER PUBLICATIONS

Invacare Lift and Slings brochure, 16 pgs. Invacare Corporation, copyright 2008.

Invacare Corporation, Invacare Lifts and Slings brochure, 8 page brochure, copyright 2004.

Sunrise Medical, Hoyer Pro, Arise for Independence brochure, 4 page brochure, copyright 2005.

ArjoHuntleigh, Maxi Sky 600, The Complete, Customized Ceiling Lift System, 8 page brochure, May 2008.

Arjo, Tenor, A Safe Handling System for Bariatric Care, 12 page brochure, Apr. 2005.

Arjo, Sara 3000, Operating and Product Care Instructions, 20 page brochure, Jun. 2003.

Joerns Healthcare, Oxford/Hoyer, 3 page brochure, date unknown.

International Search Report and Written Opinion from PCT/US2009/53083, dated Feb. 4, 2010.

Invacare Corporation, Owner's Operating and Maintenance Manual, Stand up Lift, Model RPS350-1, 60 pages, dated Jan. 11, 2006.

Office Action from U.S. Appl. No. 12/537,385, dated Apr. 28, 2011.

Response and Amendment to Apr. 28, 2011 Office Action from U.S. Appl. No. 12/537,385, dated Jul. 28, 2011.

Office action from Australian Application No. 2009269484 dated Feb. 8, 2012.

Office action from U.S. Appl. No. 12/537,385 dated Oct. 31, 2011.

Response from U.S. Appl. No. 12/537,385 dated Dec. 22, 2011.

Notice of Allowance from U.S. Appl. No. 12/537,385 dated Jan. 24, 2012.

Communication from European Application No. 09791264.6 dated Jan. 31, 2012.

Office action from New Zealand Application No. 590,353 dated Jan. 25, 2012.

Notice of Allowance from U.S. Appl. No. 12/537,385 dated Apr. 24, 2012.

Examination Report from New Zealand Application No. 590,594 dated Feb. 21, 2012.

Office action from Australian Application No. 2009579526 dated May 8, 2012.

* cited by examiner

PATIENT LIFT WITH HANGER BAR ATTACHMENT

PRIORITY CLAIM

This application claims priority from U.S. Provisional Patent Application Ser. No. 61/079,454 filed on Jul. 10, 2008 for PATIENT LIFT WITH HANGER BAR ATTACHMENT, the entire disclosure of which is fully incorporated herein by reference.

BACKGROUND

Devices for lifting and transporting patients are an important tool for caregivers and medical staff. They prevent caregiver and staff injuries such as, for example, back and other related injuries, and ensure dignity in patient handling. Such devices are typically configured to allow for attachment of a scale to measure a patient's weight. As such, these devices must be low maintenance, easy to use and safe for the caregiver and patient even when modified or retrofitted, for example, with a weight scale or other accessory attachment.

SUMMARY OF THE INVENTION

In accordance with one aspect of the present invention, a patient lift apparatus is provided that includes a hanger bar attachment bumper that comprises a soft material so as to provide a soft impact surface on the patient lift apparatus, the hanger bar attachment comprising a first and second housing adapted to be selectively connected to one another. According to another aspect of the present invention a patient lift apparatus is provided that includes a hanger bar attachment bumper that comprises a soft material so as to provide a soft impact surface on the patient lift apparatus, the hanger bar attachment bumper comprising a first and second housing adapted to be selectively connected to one another, wherein the hanger bar attachment bumper comprises a surface area and wherein the first housing makes up a larger portion of the surface area of the hanger bar attachment bumper than the second housing.

BRIEF DESCRIPTION OF THE FIGURES

The drawings are only for the purpose of illustrating preferred embodiments and are not to be construed as limiting the invention.

DETAILED DESCRIPTION

Referring to the FIGURES, this detailed description discloses embodiments of patient lift apparatuses. Patient lift apparatuses may take a variety of different forms and may be used in a wide variety of different applications. This detailed description is applicable to patient lift apparatuses of varying construction. The scope of this application is intended to encompass all combinations and sub-combinations of the features of the patient lift apparatuses disclosed in this application.

Figure 1:
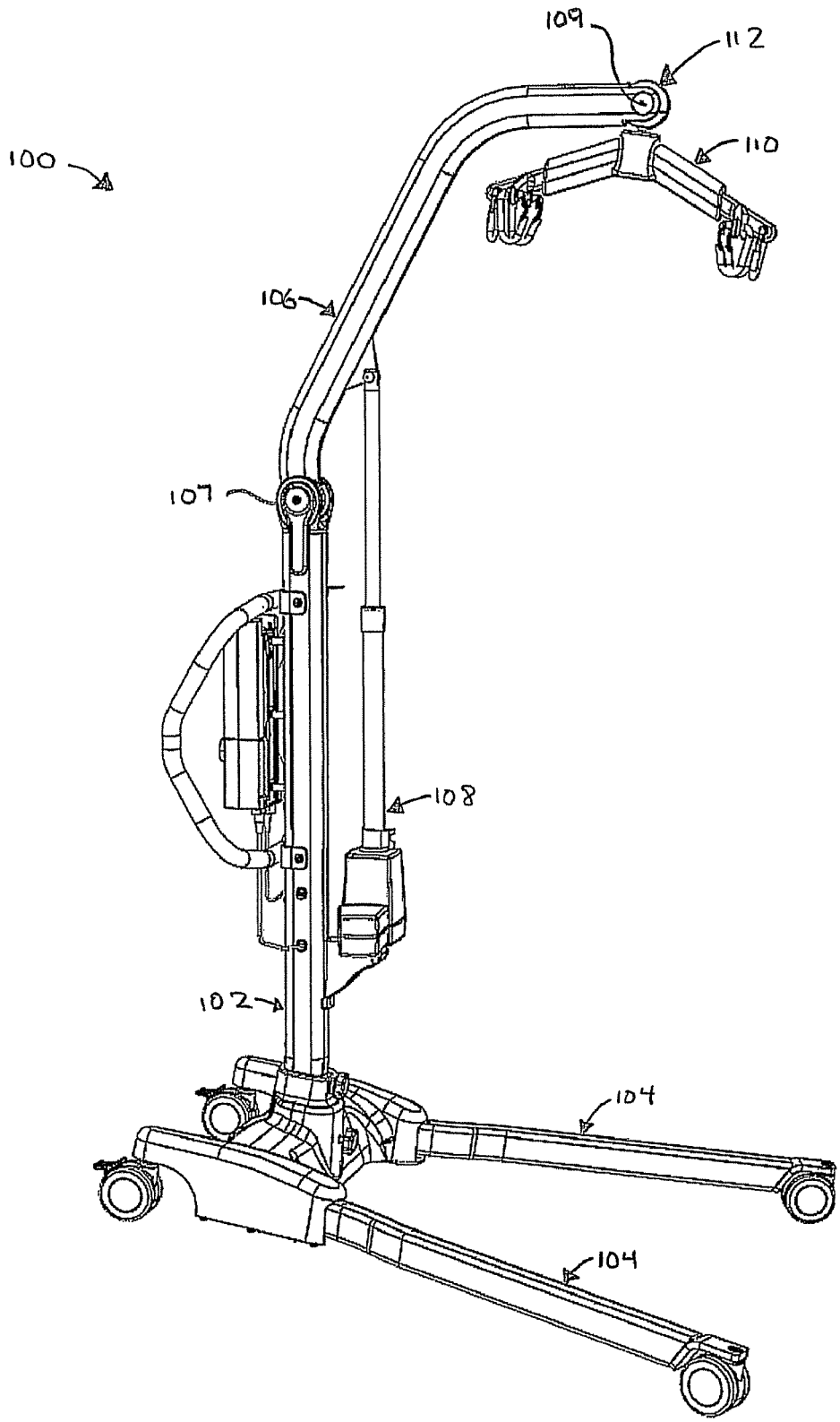
FIG. 1 is a perspective view of one embodiment of a patient lift apparatus.

Referring to FIG. 1, a perspective view of an exemplary embodiment of a patient lift apparatus 100 is illustrated. Apparatus 100 includes a central frame portion 102, base frame portion with caster leg assemblies 104, and a boom portion 106. In additional embodiments, the patient lift apparatus 100 may be provided without caster leg assemblies 104. Boom portion 106 is connected to central frame portion 102 through a pivot joint 107, which allows boom portion 106 to pivot with respect to central frame portion 102. In additional embodiments, the boom portion 106 and central frame portion 102 may be of a one-piece, unitary construction. An actuator 108 is provided to mechanically assist boom portion 106 to pivot about central frame portion 102. Actuator 108 can be, for example, an electrically driven screw-type, hydraulic, pneumatic or other similar type actuator. As described herein, when two or more objects are described as being connected, joined, affixed, or linked, they can be so connected, joined, affixed or linked directly to each other or through one or more intermediary parts or components.

Boom portion 106 further includes a hanger assembly 110 and a hanger bar attachment bumper 112. Attached to hanger assembly 110 is typically a sling (not shown) for holding a patient during lifting and transport. Hanger assembly 110 may also be provided with additional attachments or accessories. Hanger 110 is typically connected to boom portion 106 through a pivot joint 109 or other suitable connection mechanism, such as a swivel joint. Pivot joint 109 allows hanger assembly 110 to pivot as boom portion 106 is raised or lowered. One embodiment of a hanger bar attachment bumper 112 is shown generally co-located with pivot joint 109.

Figure 2:
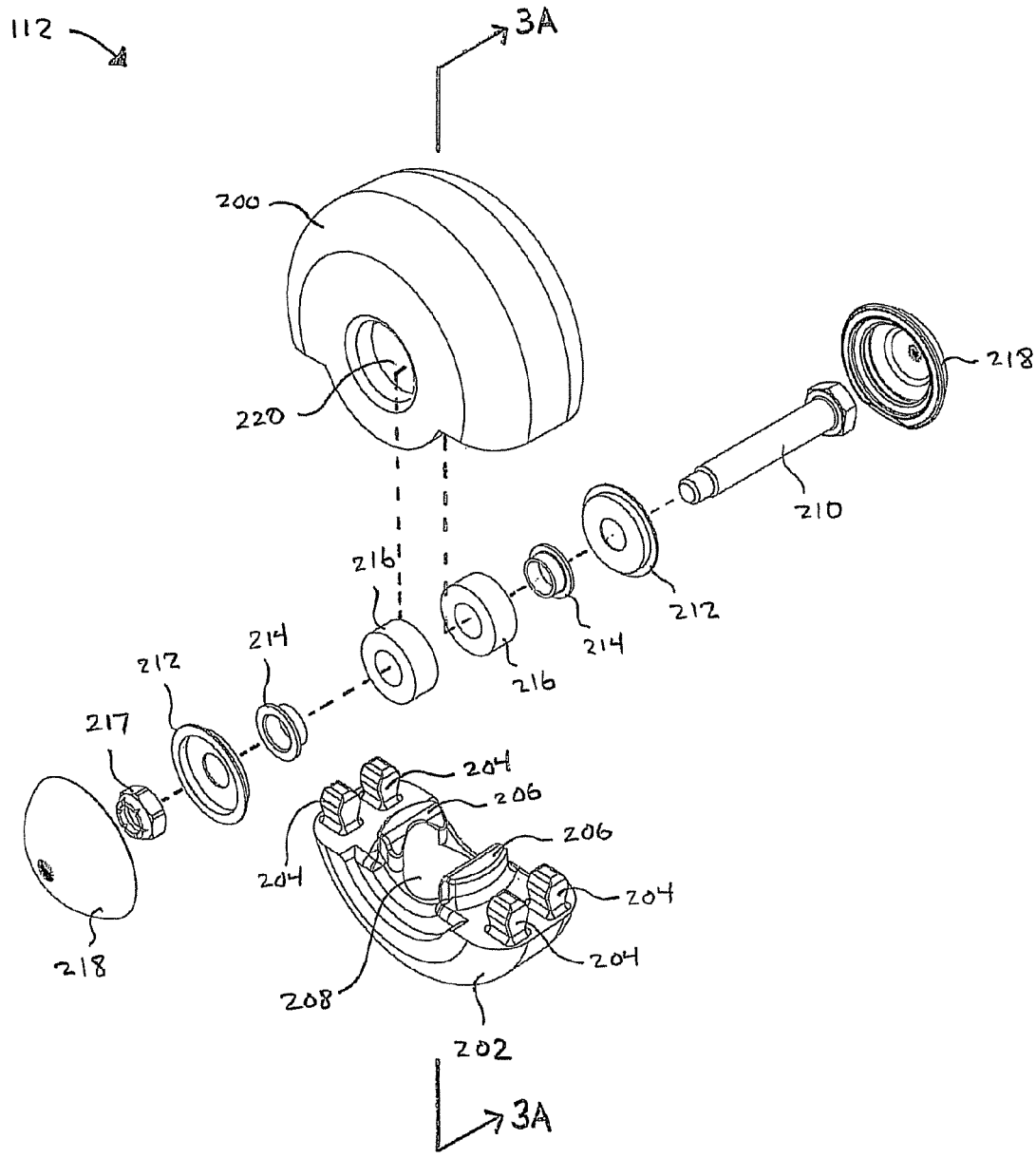
FIG. 2 is an exploded perspective view of one embodiment of a hanger bar attachment bumper.

Referring now to FIG. 2, an exploded perspective view of the hanger bar attachment bumper 112 is shown. Bumper 112 includes, for example, first and second housing portions 200 and 202. In the embodiment shown housing portions 200 and 202 are designed to connect and disconnect from each other in use. Lower housing portion 202 includes projecting members 204 that interface with upper housing portion 200. Projecting members 204 are wider in cross-section at their mid-sections than ends. This configuration provides a snap-fit type/friction fitting for removable connection to apertures located in upper housing portion 200 (shown in detail in FIG. 4). Other configurations are also possible for the snap-fit/friction connection. Upper and lower housing portions 200 and 202 are preferably made of rubber or other material so as to provide a soft impact surface.

Lower housing portion 202 also includes, for example, inner lateral projections 206 and space 208 therebetween. Space 208 allows for a shoulder bolt 210 to reside between lateral projections 206. Lateral projections 206 in lower housing portion 202 and aperture 220 in upper housing portion 200 assist in guiding shoulder bolt 210 through the bumper 112.

Received on shoulder bolt 210 are a plurality of components including, for example, washers 212, bushings 214, spacers 216 and nut 217. Bushings 214 are coaxially mounted in holes located at the end of boom 106 and provide a low-friction rotational support for shoulder bolt 210. Flanged washers 212 provide a mounting feature that retains soft impact cushioning caps 218 over the shoulder bolt 210 head and nut ends to cover any hard or sharp surfaces (as shown in the cross-sectional view of FIG. 3A).

In the embodiment shown, upper housing portion 200 is larger than lower portion 202 in that it includes more of the overall bumper housing circumference compared to lower housing portion 202. Accordingly, the upper housing portion 200 makes up a larger portion of the surface area of the bumper 112 than the lower housing portion 202. In this manner, removal of lower housing portion 202 minimizes the amount of soft impact material that is removed when lower housing portion 202 is removed from the bumper 112. In other embodiments, the proportion of material or circumference between the two housing portions may be approximately equal, or opposite from the illustrated embodiment, or any other ratio or proportion.

Figure 3A:
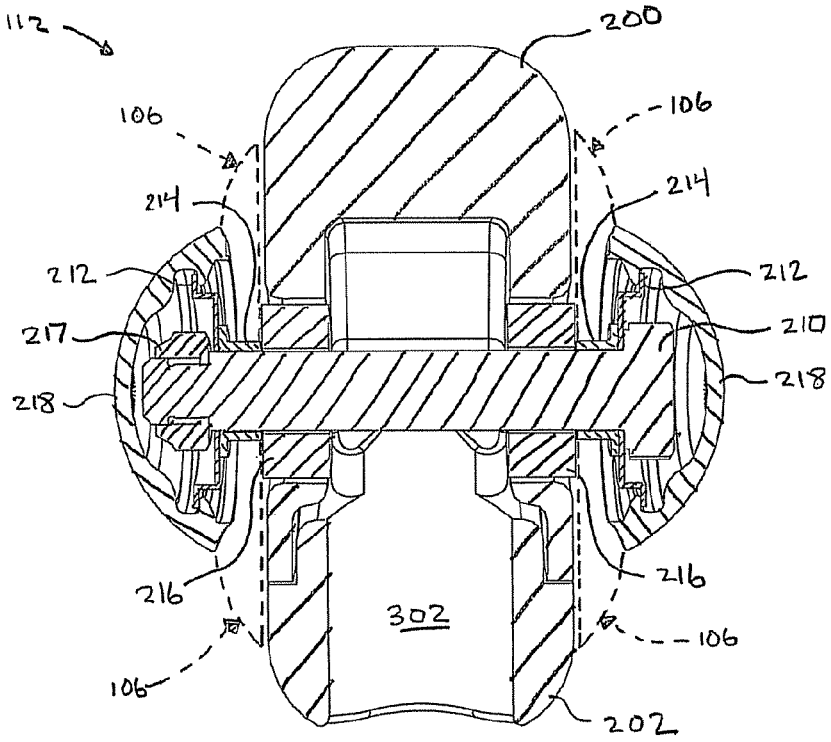
FIG. 3A is cross-sectional view of the bumper shown in FIG. 2 through section line 3A-3A.
Figure 3B:
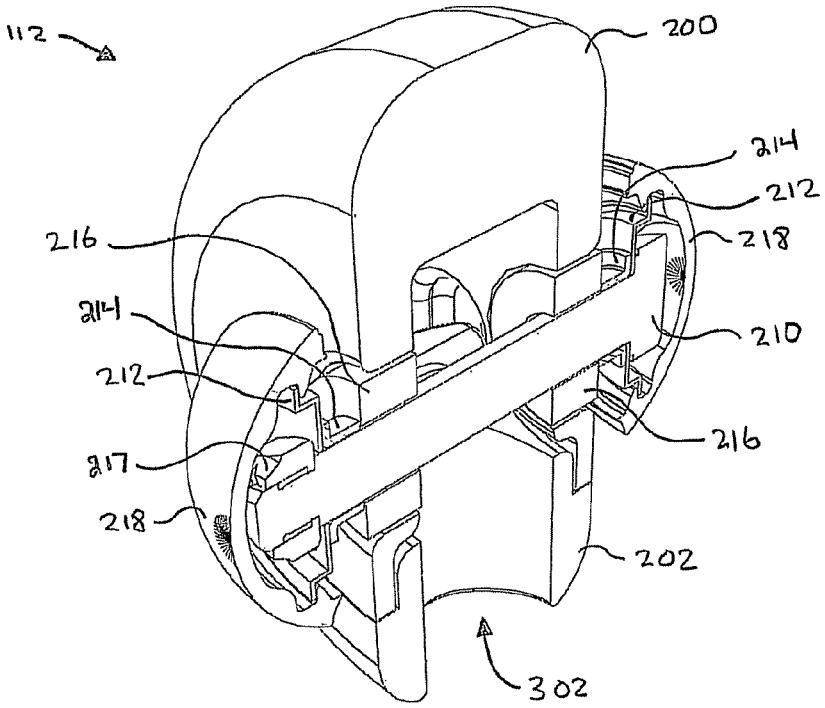
FIG. 3B is a perspective view of FIG. 3A with the cross-hatching removed.

FIGS. 3A and 3B illustrate various cross-section views of the hanger bar attachment bumper 112 in its assembled state through cross-section lines 3-3 of FIG. 2. In its assembled state, bumper 212 includes space 302. Space 302 allows a swivel bar 502 of hanger assembly 110 (shown in FIG. 5A) to connect to the shoulder bolt 210. The shoulder bolt 210 and swivel bar 502 thus form the pivot joint between the boom portion 106 and hanger assembly 110.

Figure 4:
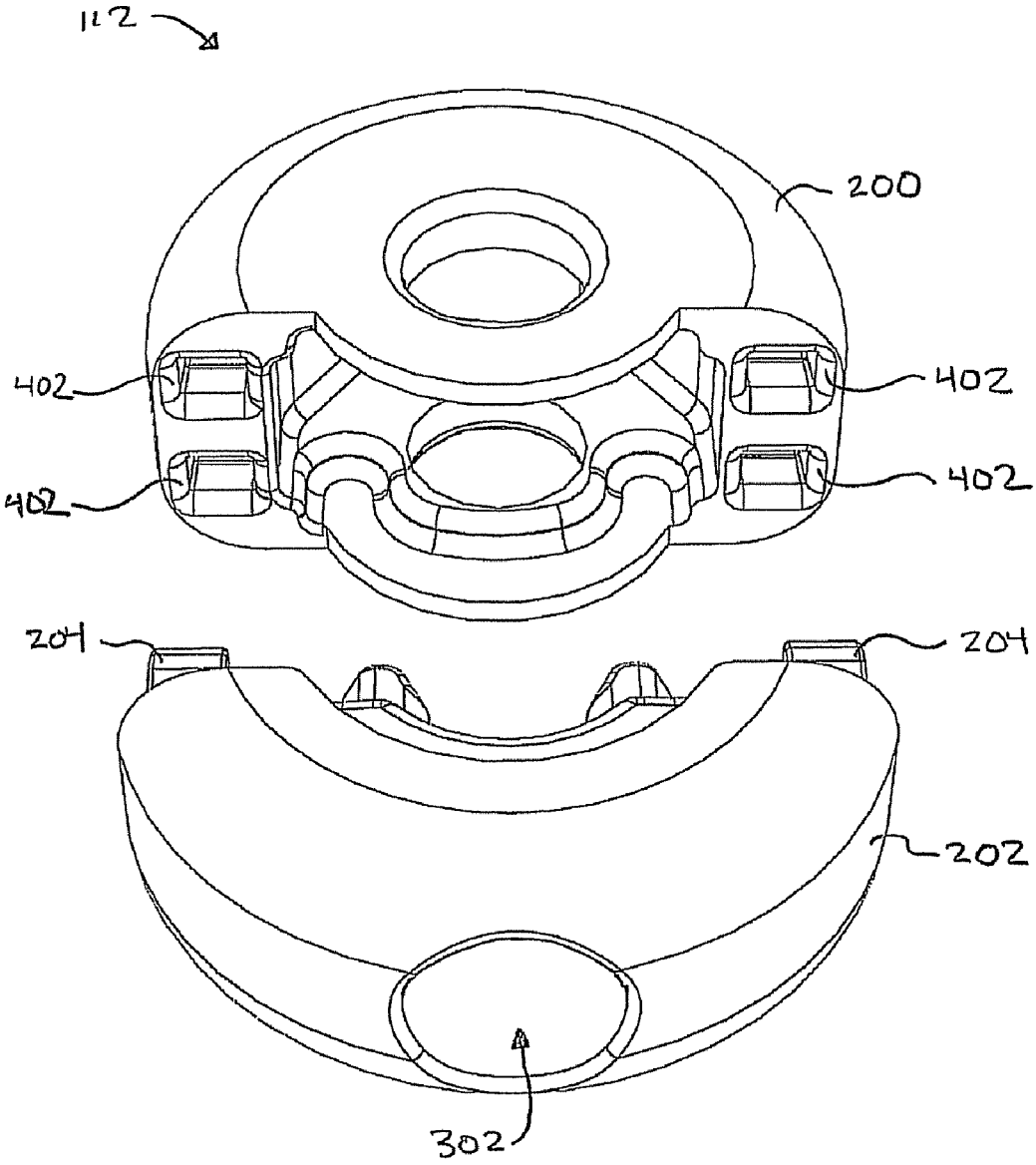
FIG. 4 is a perspective view of the bumper housing.

FIG. 4 illustrates a perspective view of hanger bar attachment bumper 112 showing the lower sections of upper housing portion 200 and lower housing portion 202. Upper housing portion 200 includes apertures or slots 402 for receiving projection members 204 of lower housing portion 202. The apertures/slots 402 are offset from a central section of upper housing portion 200 through which shoulder bolt 210 is inserted and resides. Also, apertures/slots 402 are located proximate the outer circumferential surface of upper housing portion 200. These locations are not critical and can be modified or adjusted.

In the embodiment, four apertures or slots 402 are shown and four projecting members 204 are shown. In other embodiments, the number of apertures or slots 402 and projecting members 204 can be modified to include more of less than four, such as for example two or six apertures/slots and corresponding projecting members. As described earlier, the exact form of releasable connection between upper and lower housing portions 200 and 202 is not critical, so long as the two housing portions can be easily removed and re-connected to each other.

Figure 5A:
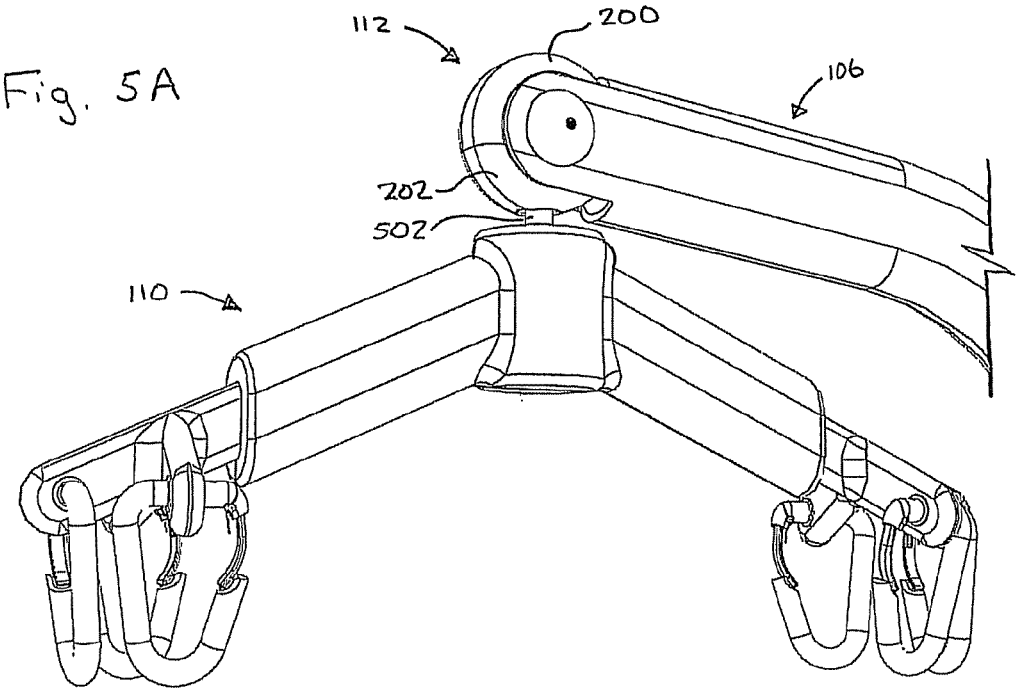
FIG. 5A is a partial perspective view of the lift apparatus and hanger bar attachment bumper.
Figure 5B:
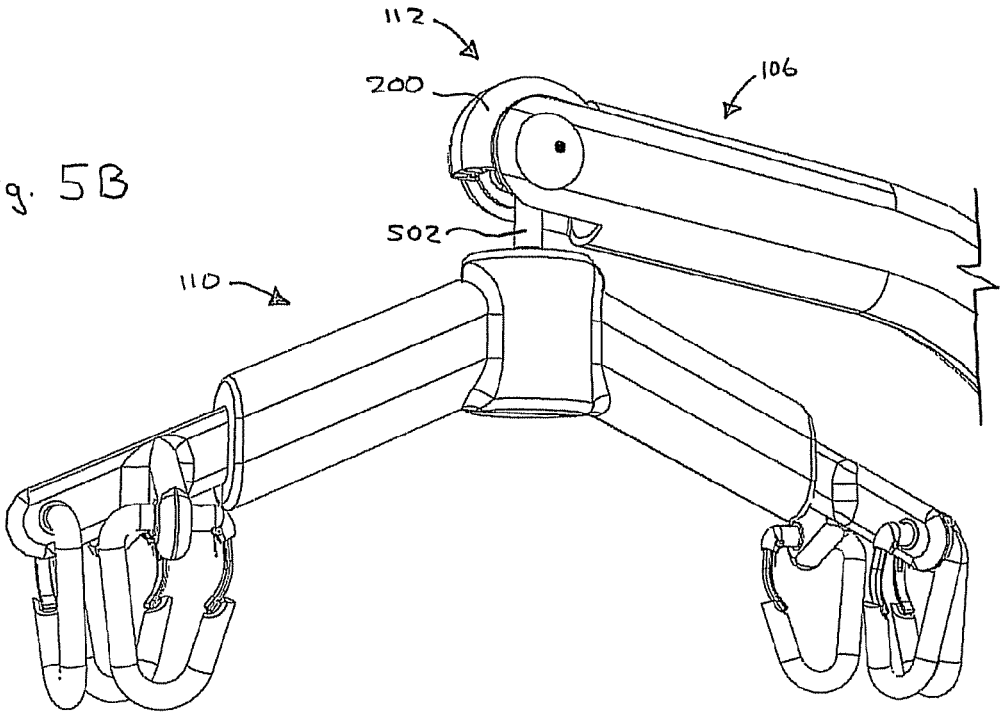
FIG. 5B is a partial perspective view of the lift apparatus and hanger bar attachment bumper with the lower portion of the bumper housing removed.
Figure 5C:
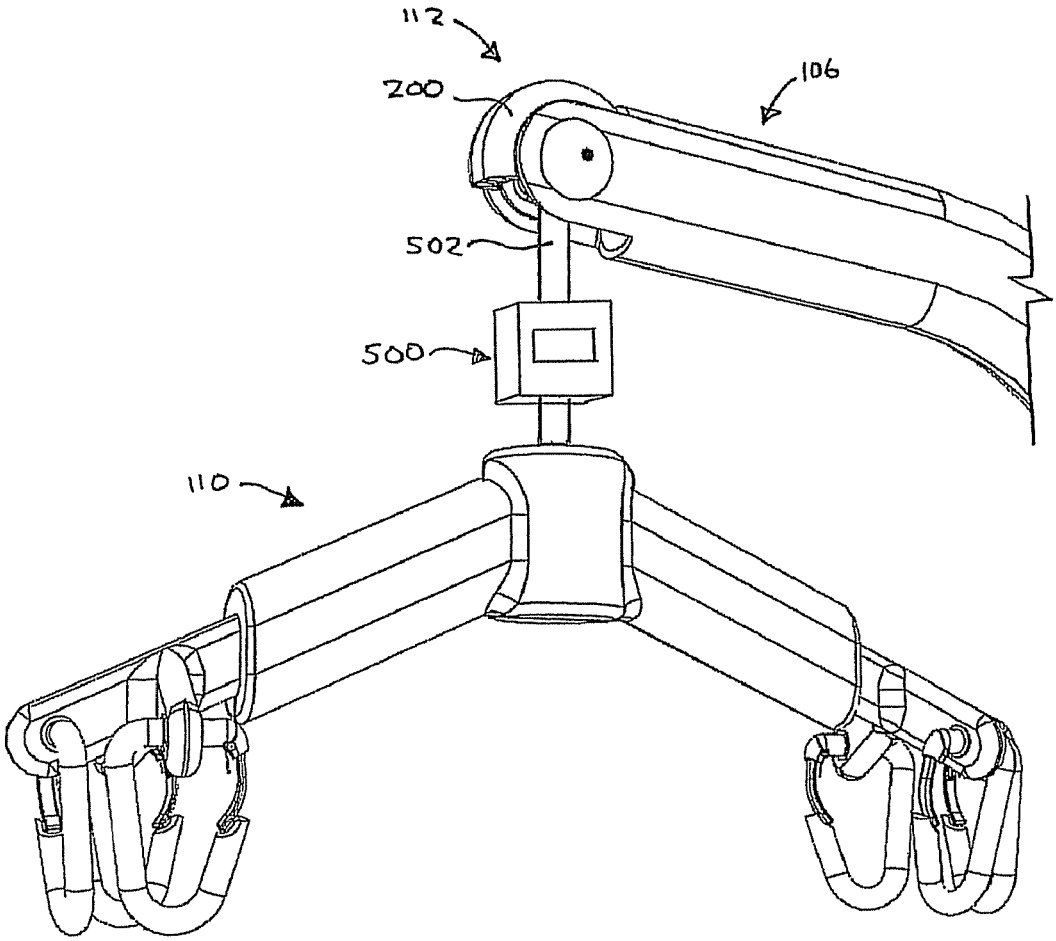
FIG. 5C is a partial perspective view of the lift apparatus and hanger bar attachment bumper with the lower portion of the bumper housing removed and an attached weight scale.

FIGS. 5A, 5B and 5C are partial perspective views of boom 106, hanger assembly 110 and bumper 112. In FIG. 5A, bumper 112 is shown with upper and lower housing portions 200 and 202 connected to each other. As shown, the diameter or overall geometric configuration of bumper 112 is such that it extends beyond the extremities of the end portion of boom 106. This configuration effectively provides a soft impact surface at the end of boom 106.

FIG. 5B shows bumper 112 with the lower housing portion 202 removed. Because upper housing portion 200 is still resident, the end portion of boom 106 still includes a soft impact surface provided by the bumper 112. FIG. 5C illustrates boom 106 with a weight scale 500 attached thereto. In addition or alternatively, other accessories may also be attached to end of boom 106 through bumper 112 such as, for example, a sling cradle. Hence, complete removal of bumper 112 is not necessary when attaching or using accessories such as a weight scale, hanger bar, or cradle to the end of boom portion 106.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasably connected together, any type of releasable connection may be suitable including for example, locking connections, fastened connections, tongue and groove connections, etc. Still further, component geometries, shapes, and dimensions can be modified without changing the overall role or function of the components. For example, the bumper 112 may include an oval, rounded polygon, or irregular geometry. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

Having thus described the many embodiments, the invention is now claimed to be:

1. A patient lift apparatus, comprising:
a frame portion;
a boom portion connected to the frame portion;
a hanger assembly connected to the boom portion; and
a hanger bar attachment bumper providing an impact surface of the boom portion, wherein the hanger bar attachment bumper comprises a first and second housing adapted to be selectively connected to one another, wherein one of the first and second housings of the hanger bar attachment bumper is adapted to be removed to allow access to an interior of the hanger bar attachment bumper thereby permitting the hanger assembly to be selectively connected or disconnected from the boom portion, and wherein the other of the first and second housing remains attached to the boom portion so as to provide the impact surface of the boom portion.

2. The patient lift apparatus of claim 1, wherein one of the first and second housing comprises a plurality of projecting members and the other of the first and second housing comprises a plurality of openings adapted to receive the plurality of projecting members to selectively secure the first housing to the second housing.

3. The patient lift apparatus of claim 2, wherein the plurality of projecting members have a larger cross-sectional area at their midpoint than at their ends.

4. The patient lift apparatus of claim 1, wherein the hanger bar attachment bumper is adapted to receive a bolt, wherein the hanger assembly attaches to the bolt, the hanger assembly thereby being connected to the boom portion.

5. The patient lift apparatus of claim 4, wherein the hanger assembly further comprises a swivel bar that attaches to the bolt.

6. The patient lift apparatus of claim 4, further comprising a weight scale located between the boom portion and the hanger assembly.

7. The patient lift apparatus of claim 1, further comprising a weight scale located between the boom portion and the hanger assembly.

8. The patient lift apparatus of claim 1, wherein the hanger bar attachment bumper comprises rubber so as to provide the impact surface of the boom portion.

9. A patient lift apparatus, comprising:
a frame portion;
a boom portion connected to the frame portion;
a hanger assembly connected to the boom portion;
a hanger bar attachment bumper providing an impact surface of the boom portion, wherein the hanger bar attachment bumper comprises a first and second housing adapted to be selectively connected to one another; and a weight scale located between the boom portion and the hanger assembly.

10. A patient lift apparatus, comprising:

a frame portion;

a boom portion connected to the frame portion;

an accessory connected to the boom portion at a connection point; and a hanger bar attachment bumper generally co-located with the connection point and comprising a housing adapted to allow access to an interior of the hanger bar attachment bumper thereby permitting the accessory to be selectively connected or disconnected from the boom portion without complete removal of the hanger bar attachment bumper.

11. The patient lift apparatus of claim 10, wherein the hanger bar attachment bumper comprises a first and second housing adapted to be selectively connected to one another, and wherein one of the first and second housings of the hanger bar attachment bumper is adapted to be removed to allow access to the interior of the hanger bar attachment bumper thereby permitting the accessory to be selectively connected or disconnected from the boom portion, and wherein the other of the first and second housing remains attached to the boom portion so as to provide an impact surface of the boom portion.

12. A patient lift apparatus, comprising:

a frame portion;

a boom portion connected to the frame portion;

a hanger assembly connected to the boom portion at a connection point; and a hanger bar attachment bumper generally co-located with the connection point and having an upper housing and a lower housing, wherein the upper and lower housing are adapted to be selectively connected to one another.

13. The patient lift apparatus of claim 12, wherein one of the upper and lower housings of the hanger bar attachment bumper is adapted to be removed to allow access to an interior of the hanger bar attachment bumper thereby permitting the hanger assembly to be selectively connected or disconnected from the boom portion, and wherein the other of the upper and lower housing remains attached to the boom portion so as to provide an impact surface of the boom portion.

14. A patient lift apparatus, comprising:

a frame portion;

a boom portion connected to the frame portion;

a hanger assembly connected to the boom portion at a connection point; and a hanger bar attachment bumper generally co-located with the connection point, wherein the hanger bar attachment bumper provides an impact surface of the boom portion, wherein the hanger bar attachment bumper comprises an upper and a lower housing adapted to be selectively connected to one another, and wherein the hanger bar attachment bumper comprises a surface area and wherein the upper housing makes up a larger portion of the surface area of the hanger bar attachment bumper than the lower housing.

15. The patient lift apparatus of claim 14, wherein one of the upper and lower housing comprises a plurality of projecting members and the other of the upper and lower housing comprises a plurality of openings adapted to receive the plurality of projecting members to selectively secure the upper housing to the lower housing.

16. The patient lift apparatus of claim 15, wherein the plurality of projecting members have a larger cross-sectional area at their midpoint than at their ends.

17. The patient lift apparatus of claim 14, wherein the hanger bar attachment bumper is adapted to receive a bolt, wherein the hanger assembly attaches to the bolt, the hanger assembly thereby being connected to the boom portion.

18. The patient lift apparatus of claim 17, wherein the hanger assembly further comprises a swivel bar that attaches to the bolt.

19. The patient lift apparatus of claim 17, further comprising a weight scale located between the boom portion and the hanger assembly.

20. The patient lift apparatus of claim 17, wherein the lower housing is adapted to be removed to allow access to an interior of the hanger bar attachment bumper thereby permitting the hanger assembly from being selectively connected or disconnected from the bolt, wherein the upper housing remains attached to the boom portion so as to provide the impact surface of the boom portion.

21. A hanger bar attachment bumper for a patient lift, wherein the hanger bar attachment bumper provides an impact surface of the patient lift, and wherein the hanger bar attachment bumper comprises a first and second housing adapted to be selectively connected to one another, and wherein one of the first and second housings of the hanger bar attachment bumper is adapted to be removed to allow access to an interior of the hanger bar attachment bumper thereby permitting a hanger assembly to be selectively connected or disconnected from the patient lift, and wherein the other of the first and second housing remains attached to the patient lift so as to provide the impact surface of the patient lift.

22. The hanger bar attachment bumper of claim 21, wherein one of the first and second housing comprises a plurality of projecting members and the other of the first and second housing comprises a plurality of openings adapted to receive the plurality of projecting members to selectively secure the first housing to the second housing.

23. The hanger bar attachment bumper of claim 22, wherein the plurality of projecting members have a larger cross-sectional area at their midpoint than at their ends.

24. The hanger bar attachment bumper of claim 22, wherein the hanger bar attachment bumper comprises a surface area and wherein one of the first housing and second housing makes up a larger portion of the surface area of the hanger bar attachment bumper than the other of the first second housing.

* * * * *